US006913498B1

(12) United States Patent
Sheth

(10) Patent No.: US 6,913,498 B1
(45) Date of Patent: Jul. 5, 2005

(54) MARINE PROPULSION SYSTEM WITH A POLYMER COMPOSITE OIL SUMP STRUCTURE

(75) Inventor: Mitesh B. Sheth, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/712,528

(22) Filed: Nov. 13, 2003

(51) Int. Cl.[7] ..... B63H 21/10
(52) U.S. Cl. ..... 440/88 L; 440/88 C
(58) Field of Search ..... 440/88 L, 88 C

(56) References Cited

U.S. PATENT DOCUMENTS 4,280,453 A * 7/1981 List et al. ..... 123/195 R
5,232,387 A * 8/1993 Sumigawa ..... 440/89 D
6,575,797 B1 6/2003 Martin et al. ..... 440/88
6,584,950 B1 7/2003 Cunningham ..... 123/195
2002/0112684 A1 * 8/2002 Jones et al. ..... 123/90.38

* cited by examiner

*Primary Examiner*—Stephen Avila
(74) *Attorney, Agent, or Firm*—William D. Lanyi

(57) ABSTRACT

A marine propulsion system is made with an oil sump that is a polymer material that is nonanodic and nonmetallic. As a result, the possibility of a galvanic circuit being created within the structure of a drive shaft housing is significantly reduced or eliminated. The result is the enhanced operation of the marine propulsion system without corrosion and the resulting destruction of the internal components within the drive shaft housing.

12 Claims, 4 Drawing Sheets

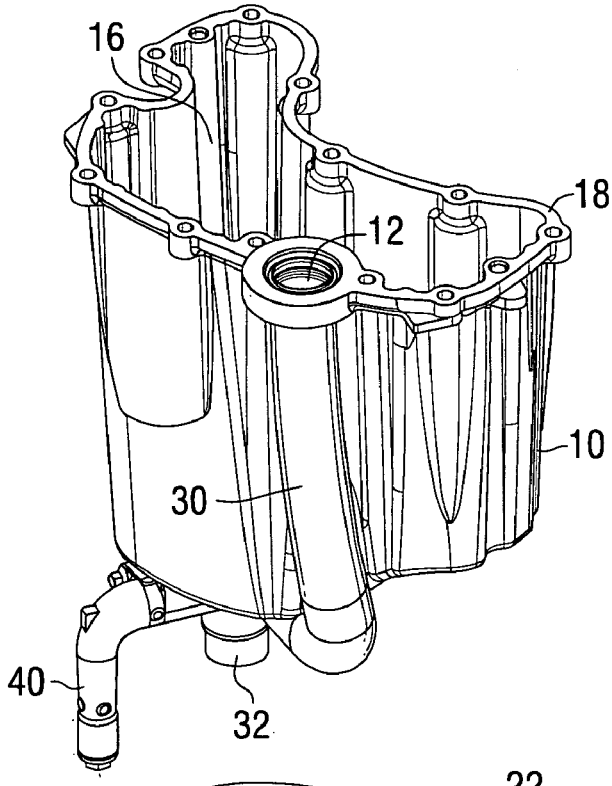
FIG. 4
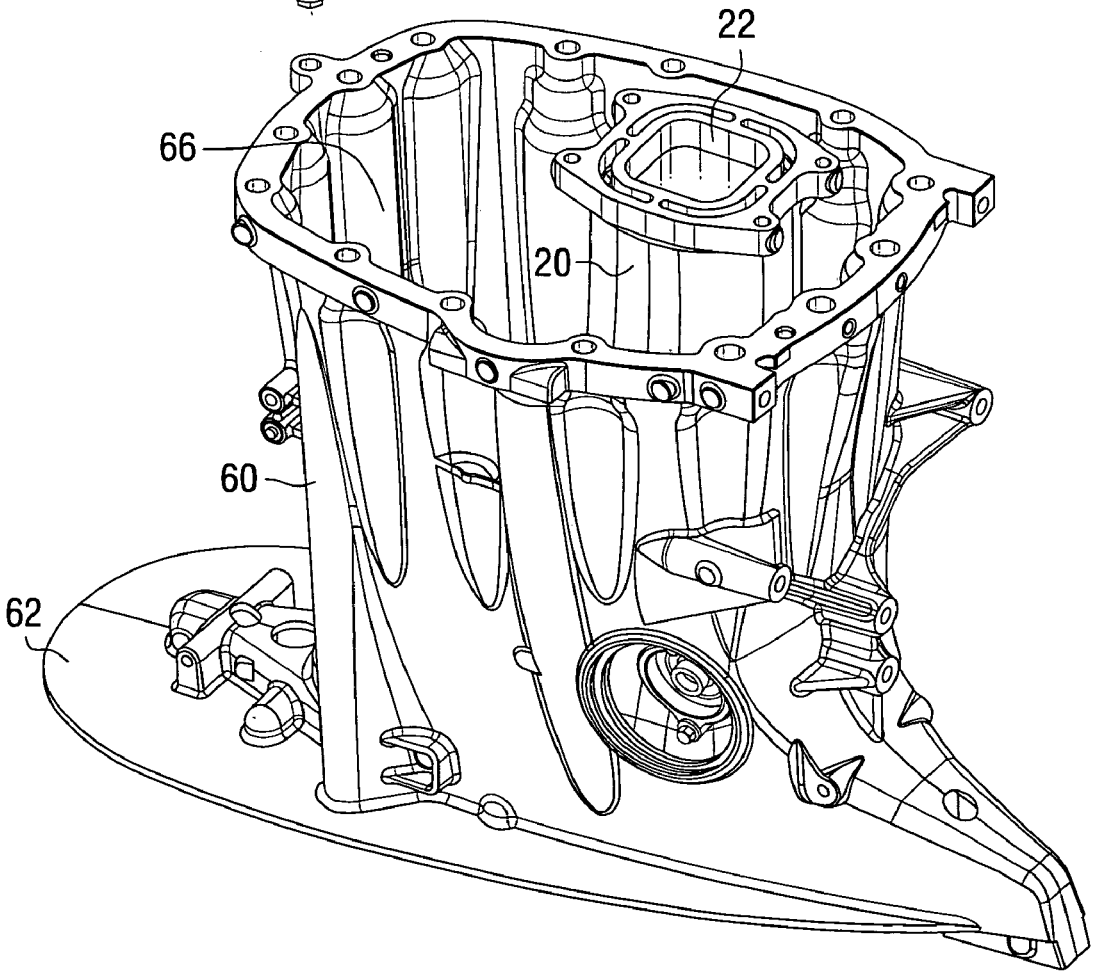

MARINE PROPULSION SYSTEM WITH A POLYMER COMPOSITE OIL SUMP STRUCTURE

BACKGROUND OF THE INVENTION

1. Field of the Invention

The present invention is generally related to a marine propulsion system, and, more particularly, to a marine propulsion system with an oil sump that is made of a polymer material with reinforcing fibers.

2. Description of the Prior Art

Various types of marine propulsion systems with oil sumps are known to those skilled in the art. U.S. Pat. No. 6,575,797, which issued to Martin et al. on Jun. 10, 2003, discloses an oil drain system for an outboard motor. The system provides an oil drain opening formed in a lower surface of the splash plate of an outboard motor at a location which allows oil to drain from the oil drain opening under the force of gravity in a downward direction without contacting any surfaces of the outboard motor. This allows the oil to be received by a waste oil container that is placed at any point directly below the oil drain opening, either on the ground below the gear case of the outboard motor or at any other point that is vertically below the oil drain opening.

U.S. Pat. No. 6,584,950, which issued to Cunningham on Jul. 1, 2003, describes an oil pan which includes a shell of plastic material (e.g. of thermoplastic polyamide), and a support structure (e.g. of metal), having a plurality of perforations, that is fixedly attached to the exterior surfaces and/or the interior surfaces of the plastic shell is described. More particularly, the oil pan comprises: a shell of plastic material having interior and exterior surfaces, the interior surfaces of the shell defining a hollow interior; and a support structure in abutting relationship with and being fixedly attached to at least one of, at least a portion of the exterior surfaces of the shell, and at least a portion of the interior surfaces of the shell. The support structure has a plurality of perforations having edges. The plastic shell is formed by molding a plastic material onto the support structure, a portion of the plastic material of the shell extends through at least some of the perforations of the support structure, the edges of the perforations are embedded in the plastic material extending there through, thereby attaching fixedly the support structure to the plastic shell. The oil pan may be used as the oil pan or reservoir of a mechanical apparatus in which oil is collected and from which the oil is redistributed, preferably continuously, during operation of the apparatus.

U.S. patent application Ser. No. 10/293,649, which was filed on Nov. 13, 2002 (M09627) by Belter et al., discloses a coolant management system for a marine propulsion device which provides a cavity within a drive shaft housing into which an oil reservoir is disposed. A water pump draws water from the body of water and causes it to flow through various coolant passages of the marine propulsion device. After passing through these coolant passages, the water is directed through a series of containments and compartments so that the level of water within the drive shaft housing varies in depth as a function of the operating speed of the internal combustion engine. The variance in depth causes a varying degree of cooling of the oil within the oil reservoir or sump.

The patents described above are hereby expressly incorporated by reference in the description of the present invention.

In known systems such as those described in U.S. Pat. No. 6,575,797 and U.S. patent application Ser. No. 10/293,649, the use of metals to form the various containments creates the possibility of the formation of a galvanic circuit which can lead to the rapid corrosion of some of those metals, particularly when the device is used in a salt water environment. It would therefore be significantly beneficial if a device could be provided which reduces the likelihood of the formation of a galvanic circuit and, as a result, reduces the likelihood of galvanic corrosion in relation to the components of the oil sump and water containment system of the marine propulsion system. Additionally, even if the oil sump was electrically isolated from other metals to prevent galvanic corrosion, pitting and intergranular corrosion of an aluminum or other metallic sump can still occur.

SUMMARY OF THE INVENTION

A marine propulsion system, made in accordance with a preferred embodiment of the present invention, comprises a first containment disposed in fluid communication with a cooling water system of the marine propulsion system and a second containment disposed within the first containment. The second containment is made of a polymer material and is disposed in fluid communication with a lubrication system of the outboard motor.

In a preferred embodiment, the first containment is a drive shaft housing and the second containment is an oil sump. The polymer material is selected from the group consisting of nylon, polyphthalamide, polyester and vinyl ester based materials. The polymer material is a matrix with reinforced fibers, in a preferred embodiment of the present invention, selected from the group consisting of glass fibers, aramid fibers, and carbon fibers.

In certain embodiments of the present invention, a water conduit is disposed within the first containment and external to the second containment. The water conduit is made of a polymer material which can be the same as the material used to manufacture the second containment. The first containment is typically made of aluminum.

BRIEF DESCRIPTION OF THE DRAWINGS

The present invention will be more fully and completely understood from a reading of the description of the preferred embodiment of the present invention in conjunction with the drawings, in which:

FIG. 4 shows an exploded view of a drive shaft housing, an exhaust conduit, and an oil sump made in accordance with the present invention.

DESCRIPTION OF THE PREFERRED EMBODIMENT

Figure 1:
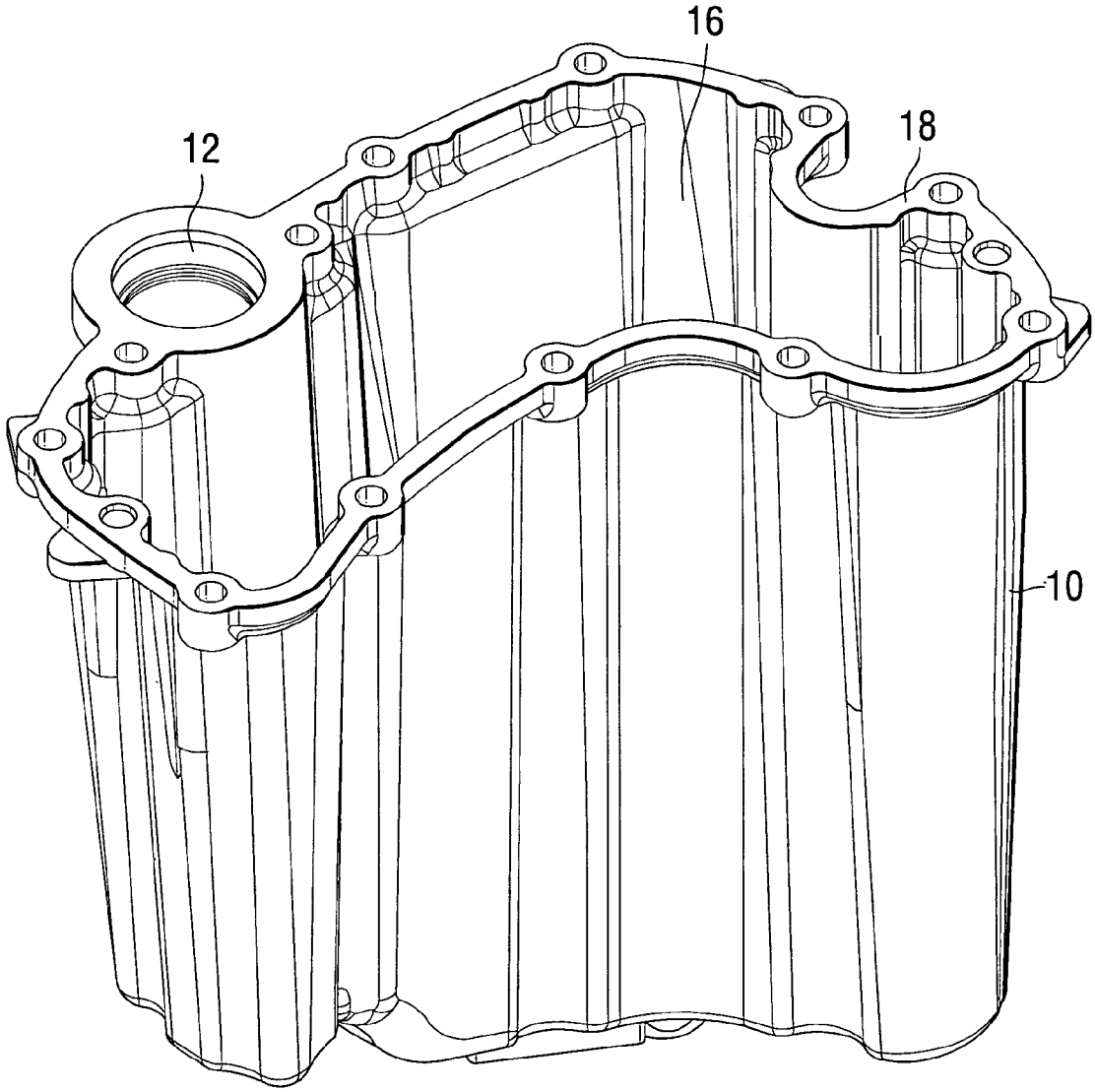
FIG. 1 shows an oil sump made in accordance with the present invention.

Throughout the description of the preferred embodiment of the present invention, like components will be identified by like reference numerals.

FIG. 1 is an isometric representation of an oil sump 10 made in accordance with the preferred embodiment of the present invention. An opening 12 is formed in the structure and, as will be described in greater detail below, shaped to receive a water conduit. Within the cavity 16 of the oil sump 10, a quantity of oil can be contained during the operation of an internal combustion engine of a marine propulsion system for recirculation to and from certain regions of the engine and associated components that require lubrication. The upper surface 18 of the structure of the oil sump 10 is shaped to be attached in sealing relation with an undersurface of the internal combustion engine.

Figure 2:
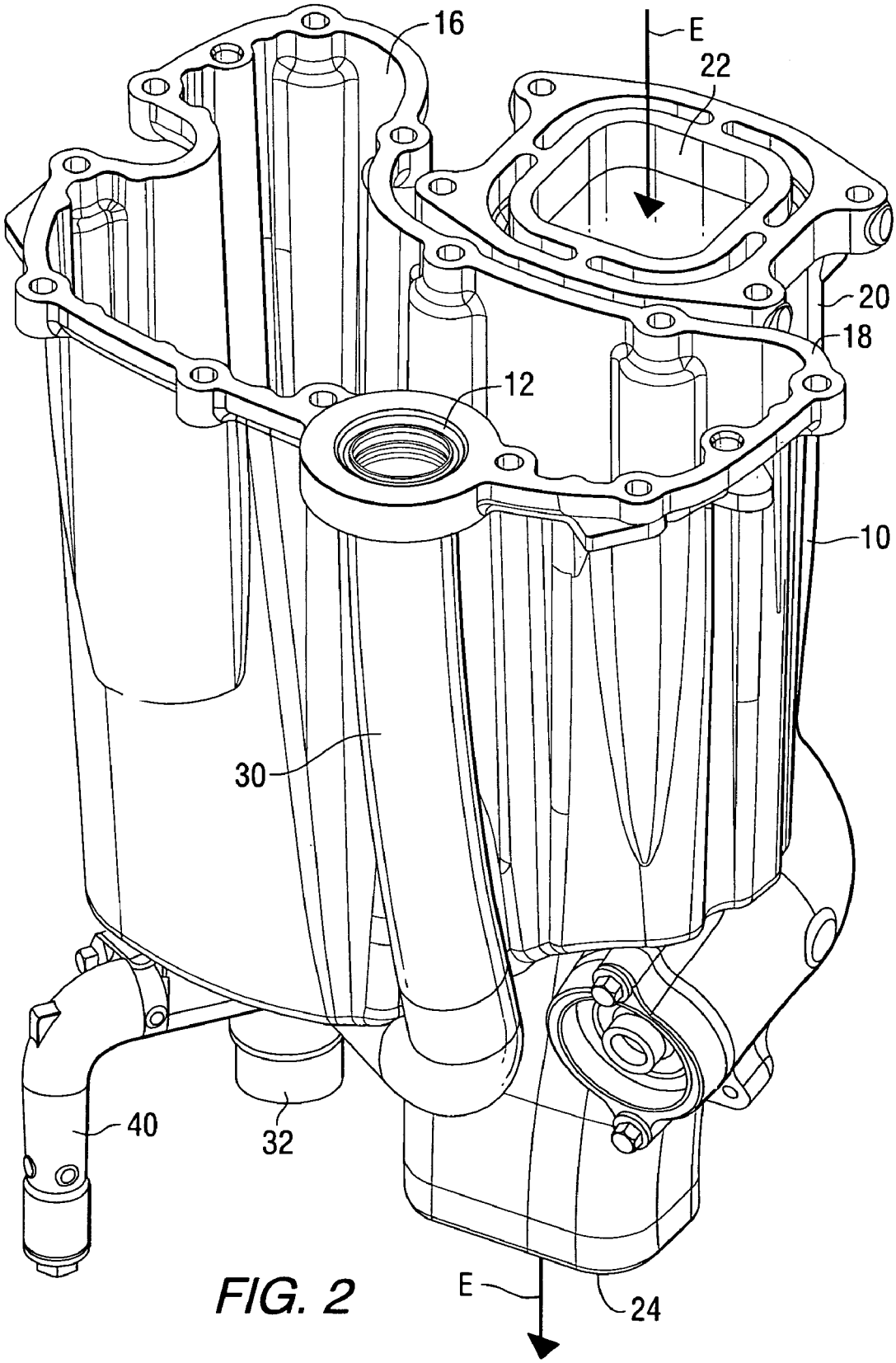
FIG. 2 shows the oil sump of FIG. 1 in combination with an exhaust conduit of a marine propulsion system.

In FIG. 2, the oil sump 10 is shown in relation to several other components of a marine propulsion system. Adjacent to the oil sump 10 is an exhaust conduit 20 which has an upper inlet portion 22 and a lower outlet portion 24. Exhaust gases are conducted downwardly, from an engine exhaust manifold, through the exhaust conduit 20, as represented by Arrows E.

In FIG. 2, a water conduit 30 is shown attached to the opening 12. The purpose of the water conduit 30 is to conduct a flow of water from an inlet end 32, which is attached to a water pump (not shown), upwardly toward the cooling system of an engine of a marine propulsion system. Also shown in FIG. 2 is an oil drain 40 which is generally similar to that which is the subject of U.S. Pat. No. 6,575,797, described above. The basic operation of the oil sump 10 and its associated components and conduits is described in both U.S. Pat. No. 6,575,797 and U.S. patent application Ser. No. 10/293,649. Therefore, the detailed operation of these conduits and components will not be further described herein.

Figure 3:
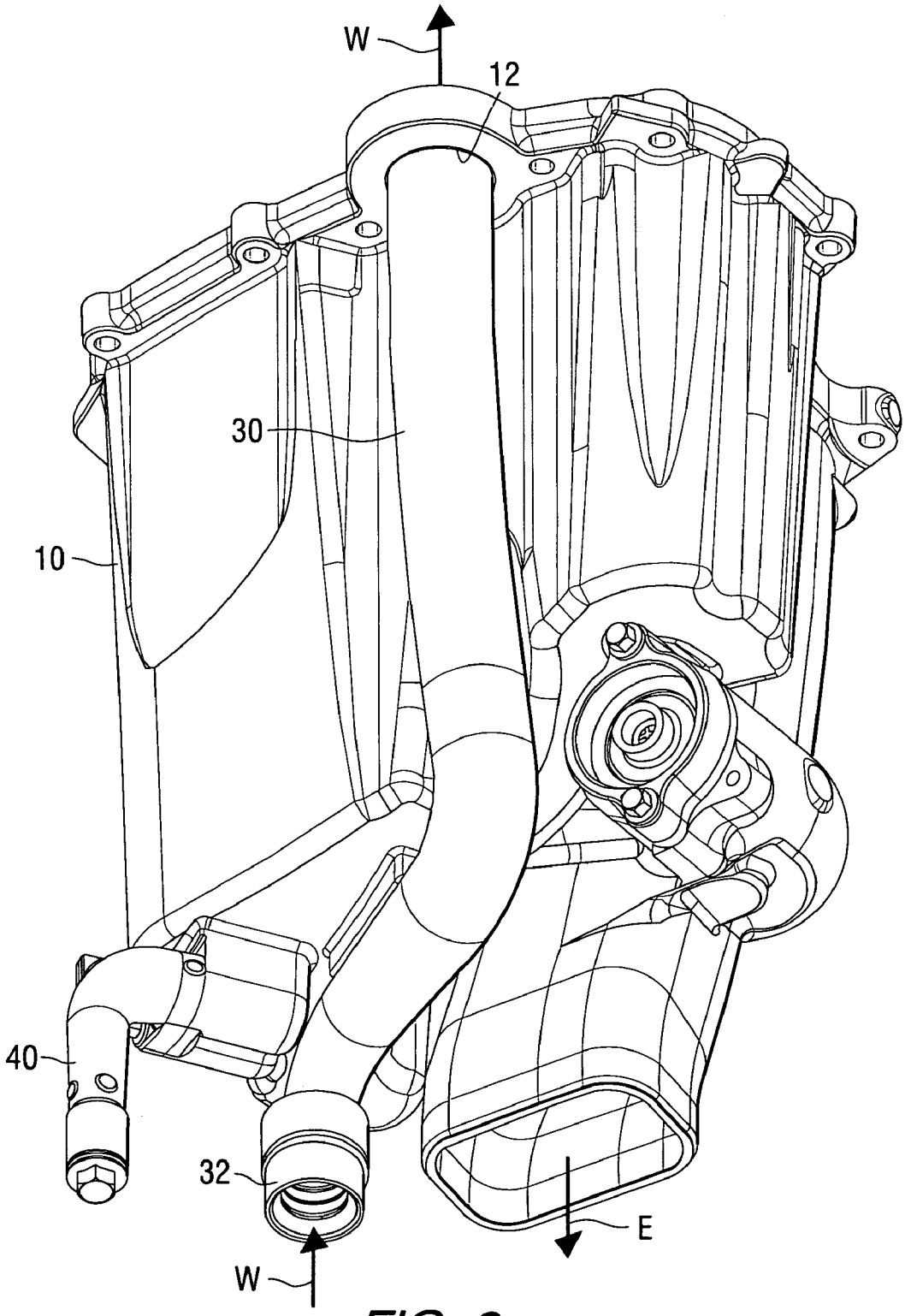
FIG. 3 is a slightly different view of the isometric representation of FIG. 2.

FIG. 3 is generally similar to FIG. 2, but the isometric view is such that the bottom portion of the structure is more visibly represented. Arrows W represent the flow of water from the inlet end 32 of the water conduit 30, under the influence of a water pump (not shown in FIGS. 2 and 3) to cause water to flow upwardly from the bottom portion of a first containment within the drive housing of an outboard motor toward an engine which is located above the upper surface 18 of the oil sump 10.

In FIG. 4, a drive shaft housing 60, with its anti-cavitation plate 62, is shown in association with an oil sump 10. In the representation of FIG. 4, the exhaust conduit 20 is disposed within the cavity 66 of the drive housing 60. As described above, this exhaust conduit 20 was shown disposed proximate the oil sump 10. When the oil sump 10, in FIG. 4, is lowered into the cavity 66 of the drive shaft housing 60, the relative positions of the oil sump 10 and the exhaust conduit 20 will be similar to those shown in FIG. 2.

With continued reference to FIG. 4, it can be understood that when the oil sump 10 is lowered into the cavity 66 of the drive shaft housing 60, a space will exist around the outer surface of the oil sump 10 and within the cavity 66. This space is intended to be at least partially filled with water as explained in greater detail in U.S. Pat. No. 6,575,797 and U.S. patent application Ser. No. 10/293,649. Within the internal cavity 16 of the oil sump 10, a quantity of liquid lubricant is intended to be stored as it is recirculated throughout lubricating passages of the engine and associated components.

With reference to FIGS. 1–4, it should be understood that the possibility of a galvanic circuit exists within the structure of FIG. 4 when metals of different electrochemical potential are used in combination within the structure. As an example, the drive shaft housing 60 is typically made of aluminum which is coated with a protective coating to inhibit corrosion. Similarly, the oil sump 10 is typically made of aluminum which may or may not be coated. The water conduit 30 is typically made of copper because of the malleability of copper and the ease with which the complicated shape of the water conduit 30 can be formed with copper. As a result, the presence of copper of the water conduit 30 and aluminum of the oil sump 10, disposed within a water containing cavity 66 creates the high likelihood of a galvanic circuit within the partially water filled cavity 66. This condition is particularly exacerbated when the water is salt water. This presence of salt water is the result of the use of the marine propulsion system in a salt water environment.

The galvanic circuit described above can exist in several ways. First, the presence of a copper water conduit 30 in close proximity with the aluminum oil sump 10 within a water environment can quickly create the galvanic circuit which will rapidly result in galvanic corrosion of the aluminum components. In addition, the existence of the aluminum oil sump 10 disposed within the aluminum drive shaft housing 60 can also result in a galvanic circuit if the two aluminum alloys are not virtually identical in chemical composition. In addition, even though the aluminum components may be coated with a protective coating, any imperfections in the coating will allow corrosion to occur, particularly in the presence of salt water within the cavity 66 and surrounding the oil sump 10. If copper ions are deposited on the aluminum, pitting corrosion of the aluminum can also occur.

In order to fully understand the advantages of the present invention, it must be recognized that the containments, such as the oil sump 10 and the drive shaft housing 60, of marine propulsion systems are traditionally made from aluminum or, in certain cases, steel components. These are highly prone to various forms of marine corrosion. Galvanic corrosion occurs in these products when electrical contact exists with dissimilar metals, such as copper and aluminum or different alloys of aluminum. In addition to galvanic corrosion, aluminum oil sumps can be severely corroded from copper ion deposition if the copper alloys are closely adjacent to the aluminum surface. Another disadvantage of traditional oil sump construction is that it is comparatively heavy, particularly when manufactured of higher density materials such as steel or metallic structures such as aluminum. Regardless of the later coating of these components with chromate conversion materials or electrically deposited paint, they are still susceptible to corrosion.

In order to avoid these significant disadvantages of known marine propulsion system structures, the present invention provides an oil sump 10 that is completely made of a polymer composite. Although certain metallic hardware components can be added to the structure of the sump, its primary structure is a polymer composite such as nylon, polyphthalamide, polyester, or vinyl ester based materials. In certain embodiments, the polymer composite contains reinforcing fibers which can be glass fibers, aramid fibers or carbon fibers or mineral fillers. The oil sump can be manufactured by various techniques such as injection molding, compression molding or resin transfer molding (RTM). These various techniques are well known to those skilled in the art of polymer component manufacture.

In addition to the significant corrosion benefits of the present invention, it should also be understood that the resulting products can be significantly lighter and easier to manufacture than if they were made of aluminum or steel. In addition, they can be used in combination with other components that are metallic since the polymer materials do not form galvanic circuits even when used with metallic components. For reference, the density of a polymeric material used in the present invention is 1.3 to 1.5 gm/cm$^3$. Aluminum is typically 2.8 gm/cm$^3$, and steel is 7.8 gm/cm$^3$. The invention oil sump does not require machining or additional finishing operations, as compared to the metallic material. Structural borne noise is also mitigated using the inventive polymer oil sump because it dampens acoustic emissions over two orders of magnitude better than existing metallic oil sumps.

As described above, the use of a polymer oil sump, even in conjunction with metallic structures such as the drive shaft housing, will reduce or eliminate the likelihood of galvanic corrosion. The use of a nonmetallic material, such as a polymer material with reinforcing fibers, reduces the overall weight of the structure, is more easily manufactured, minimizes noise, and eliminates the possibility of corrosion occurring in conjunction with the oil sump structure.

Although the present invention has been described in particular detail and illustrated to show a preferred embodiment, it should be understood that alternative embodiments are also within its scope.

What is claimed is:

1. A marine propulsion system, comprising:

a first containment disposed in fluid communication with a cooling water system of said outboard motor;

a second containment disposed within said first containment, said second containment being made of a polymer material, said second containment being disposed in fluid communication with a lubrication system of said outboard motor; and a water conduit disposed within said first containment and external to said second containment, said water conduit being made of said polymer material.

2. The marine propulsion system of claim 1, wherein:

said first containment is a drive shaft housing.

3. The marine propulsion system of claim 1, wherein:

said second containment is an oil sump.

4. The marine propulsion system of claim 1, wherein:

said polymer material is selected from the group consisting of nylon, polyphthalamide, polyester, and vinyl ester based materials.

5. The marine propulsion system of claim 1, wherein:

said polymer material is a matrix with reinforcing fibers.

6. The marine propulsion system of claim 5, wherein:

said reinforcing fibers are selected from the group consisting of glass fibers, aramid fibers, carbon fibers and mineral fillers.

7. The marine propulsion system of claim 1, wherein:

said first containment is made of aluminum.

8. A marine propulsion system, comprising:

a drive shaft housing disposed in fluid communication with a cooling water system of said outboard motor;

an oil sump disposed within said drive shaft housing, said oil sump being made of a nonanodic material, said oil sump being disposed in fluid communication with a lubrication system of said outboard motor; and a water conduit disposed within said drive shaft housing and external to said oil sump, said water conduit being made of said nonanodic material.

9. The marine propulsion system of claim 8, wherein:

said nonanodic material is selected from the group consisting of nylon, polyphthalamide, polyester, and vinyl ester based materials.

10. The marine propulsion system of claim 8, wherein:

said nonanodic material is a polymer matrix with reinforcing fibers.

11. The marine propulsion system of claim 10, wherein:

said reinforcing fibers are selected from the group consisting of glass fibers, aramid fibers, carbon fibers and mineral fillers.

12. The marine propulsion system of claim 8, wherein:

said drive shaft housing is made of aluminum.

* * * * *

UNITED STATES PATENT AND TRADEMARK OFFICE

CERTIFICATE OF CORRECTION

PATENT NO. : 6,913,498 B1
DATED : June 5, 2005
INVENTOR(S) : Sheth

It is certified that error appears in the above-identified patent and that said Letters Patent is hereby corrected as shown below:

Title page,
Item [75], should read:
-- [75] Inventors: Mitesh B. Sheth
Steve Wynveen
Wesley R. Martin --.

Signed and Sealed this

Thirtieth Day of August, 2005

JON W. DUDAS
*Director of the United States Patent and Trademark Office*